US009462886B2

(12) United States Patent
Johnson

(10) Patent No.: US 9,462,886 B2
(45) Date of Patent: Oct. 11, 2016

(54) PROTECTIVE EDGE GUARD

(71) Applicant: Jessica Anne Johnson, Charlotte, NC (US)

(72) Inventor: Jessica Anne Johnson, Charlotte, NC (US)

( * ) Notice: Subject to any disclaimer, the term of this patent is extended or adjusted under 35 U.S.C. 154(b) by 23 days.

(21) Appl. No.: 14/536,671

(22) Filed: Nov. 9, 2014

(65) Prior Publication Data

US 2016/0128478 A1 May 12, 2016

(51) Int. Cl.
*A47K 1/08* (2006.01)
*A47B 95/04* (2006.01)
*A47B 13/08* (2006.01)

(52) U.S. Cl.
CPC ..... *A47B 95/043* (2013.01); *A47B 13/083* (2013.01)

(58) Field of Classification Search
CPC ..... Y10T 428/24008; A47B 45/043
USPC ..... 428/99
See application file for complete search history.

(56) References Cited

U.S. PATENT DOCUMENTS 5,715,546 A * 2/1998 Kvalvik ..... A47K 3/125 4/580
7,182,993 B1 * 2/2007 Hamilton ..... A47B 95/043 108/27
2006/0213004 A1 * 9/2006 Bennett ..... E04H 4/141 4/506
2008/0187709 A1 * 8/2008 Hester ..... A47G 23/0306 428/99
2008/0289092 A1 * 11/2008 Brown ..... A45D 19/10 4/519
2011/0117808 A1 * 5/2011 Fair ..... A63H 33/006 446/227

* cited by examiner

*Primary Examiner* — Alexander Thomas

(57) ABSTRACT

The present invention provides an apparatus for protecting an infant or small child from injury in the event of unintentional impact with a hard edge or corner. The invention is a pliable guard which can bend around an edge, and adhere to a smooth hard surface via suction cups which are included and positioned periodically along the underside of the guard. The protective guard is comprised of a top surface, bottom surface, and a cushioned middle section which acts as the protective barrier against the edge or corner being covered. The invention is intended for use along the edges of a kitchen sink to protect a child from injury during bath time, or along any edge or corner that may pose a potential risk of injury upon impact to children or adults.

2 Claims, 5 Drawing Sheets

PROTECTIVE EDGE GUARD

CROSS-REFERENCE TO RELATED APPLICATIONS

Not applicable

STATEMENT REGARDING FEDERALLY SPONSORED RESEARCH OR DEVELOPMENT

Not applicable

REFERENCE TO SEQUENCE LISTING, A TABLE, OR A COMPUTER PROGRAM LISTING COMPACT DISC APPENDIX

Not applicable

BACKGROUND OF THE INVENTION

1. Field of the Invention

The present invention relates to a protective guard that can affix, via suction cups, to any smooth surface, such as around the edge of a sink, a corner, or any edge of a table top or the like, in order to protect against bodily injuries in the event of harmful contact with the hard edge or surface.

2. Description of Prior Art

Bathing a squirming, slippery baby can be a difficult task, especially if you are bending over a bathtub or trying to use a portable bathtub resting on the floor or even a counter top. Portable bathtubs are generally cumbersome to store and can really only be used for a short time period of a baby's infancy. Once the baby grows to a certain size and becomes more active, portable tubs, and infant size bathers are no longer useful, as the baby can squirm right out of them. Portable tubs, often placed on counter tops, can also slip off the surface, or tip over. However, the kitchen sink is generally an easy to reach bathing area and no additional storage space is needed to store a tub once the bath has concluded. One of the main risks associated with bathing a baby in the sink is the edge of the sink or counter, especially if the baby slips or flings himself backwards, thereby hitting his head or body against a hard corner or surface of the sink or surrounding counter top.

Currently some people use layers of towels or foam padding on the edges of a kitchen sink during bath time. However, the towels are not secured to the edge and can easily be pulled into the sink, thus creating a wet mess and removing the protective guard. Another option often used is a foam guard. Unfortunately though, the foam can be ripped apart or chewed on by a baby or child, thus creating a choking hazard and again, removing the protective guard. Many edge guards use double sided adhesive tape, which does not offer a very strong bond, especially when wet. Children can pull the guard from the edge with very little strength. Over time, after many removals from the child, the adhesive tape loses the ability to adhere to any surface, leaving the edge or corner exposed. Other options used to protect an infant include inflatable devices, which can be collapsible and deflated by a puncture or tear, rendering the device useless.

Examples of prior art include U.S. Pat. No. 3,931,652 entitled Infant Bathing Apparatus; U.S. Pat. No. 5,809,901 entitled Table Edge Bumper Assembly; U.S. Pat. No. 7,886,737 B2 entitled Protective Edge Guard; U.S. Patent Application Publication No. US 2011/0041244 A1 entitled Child Bathing Apparatus; U.S. Pat. No. 5,735,000 entitled Infant Bathing Apparatus with Faucet Guard; U.S. Pat. No. 8,695,129 entitled Portable Bath Tub Apparatus; U.S. Pat. No. 8,250,684 entitled Baby Bath Insert; U.S. Pat. No. 4,602,394 entitled Baby Bather; U.S. Pat. No. 5,809,588 entitled Collapsible Baby Tub; U.S. Pat. No. 4,216,552 entitled Sink Mounted Infant Bathing Device; U.S. Pat. No. 4,838,967 entitled Baby's Bath; U.S. Pat. No. 5,345,622 entitled Method of Fabricating Inflatable Bathing Tub and Associated Support Apparatus; U.S. Pat. No. 6,507,959 entitled Bath Station; U.S. Pat. No. 5,361,430 entitled Baby Bath Tub; and U.S. Pat. No. 3,869,106 entitled Safety Bumper for Furniture.

Therefore, a need exists for a protective edge guard that is not easily removed from a surface, and cannot be easily chewed, ripped, or deflated. Additionally, the guard needs to be easy to use, easy to store, easily portable, and easily cleaned. Ideally, the guard could also be affixed to the corners of walls, edges of counters, edges of table tops, and other like, smooth surfaces.

BRIEF SUMMARY OF INVENTION

The present invention is a pliable protective guard that can bend around and temporarily attach, via suction cups, to a smooth hard surface in order to protect a child or person against harmful contact with the edge of the hard surface. In the preferred embodiment, the edge guard is designed to cover the edges of a sink, corners of walls, edges of tables, countertops, and any other edge that could pose a potential bodily injury from unintentional impact.

The protective edge guard has a top surface, a bottom surface, a cushioned middle section, and suction cups included along the bottom surface.

The top surface may contain characters, designs, shapes, or the like as decoration in order to entertain children. Optionally, the top surface may also contain bumps or ridges The cushioned middle section of the invention is comprised of an inner filling of compressible material, such as silicone or rubber. The middle section does not need to be extremely thick, but thick enough to create a protective barrier along the edge being covered. The middle section remains pliable enough to be able to bend around an edge or corner.

The bottom surface is generally a smooth, flat surface containing a plurality of suction cups. Optionally the bottom surface can contain bumps or ridges. The suction cups are spaced periodically along the underside of the guard. The suction cups will adhere to most any smooth surface, such as the side of a sink, counter top, table edge, or even the corner of a wall.

Optionally, holes and loops can be included in the protective edge guard in order to allow toys to be connected. For example, toys could be connected to the loop, or placed through the hole, in order to distract and entertain the child during bath time.

In the preferred embodiment, the present invention is one piece and made of a flexible silicone, plastic, or rubber-like material that can easily bend around an edge or corner. Ideally, the material is safe for children, is easily cleaned, preferably dishwasher safe, and non-toxic. Additionally, the material used may be an anti-slip material. Thus, the material used can be determined by those skilled in the art. In the preferred embodiment, the protective edge guard can be customized and cut to fit a range of different lengths, in order to fit a variety of kitchen sink sizes, edges, and corners.

BRIEF DESCRIPTION OF THE SEVERAL VIEWS OF THE DRAWING

A more complete understanding of the invention is further illustrated by reference to the following drawings in conjunction with the detailed description, in which like numerals refer to like elements in the various views.

DETAILED DESCRIPTION OF THE INVENTION

Figure 1:
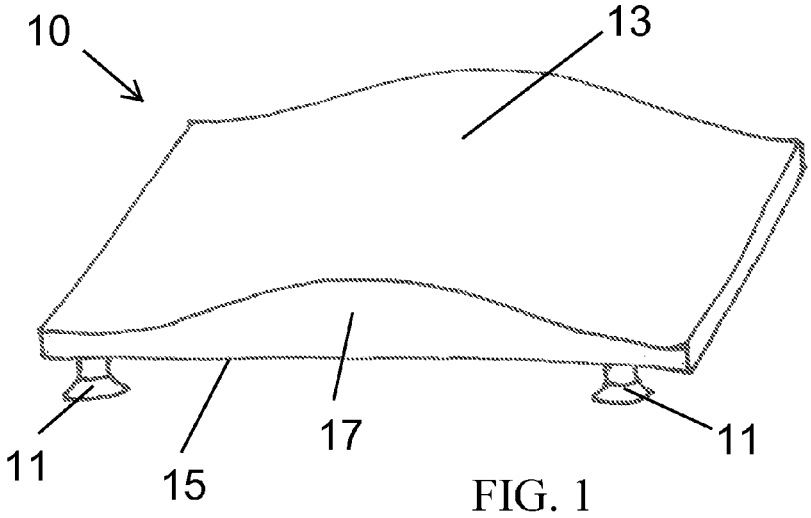
FIG. 1 is a perspective view of the top of the protective edge guard.

Referring to FIG. 1, the present invention relates to a protective edge guard 10, comprised of a top surface 13, a bottom surface 15, and a cushioned center section 17. A plurality of suction cups 11 is included along the bottom surface 15.

Figure 2:
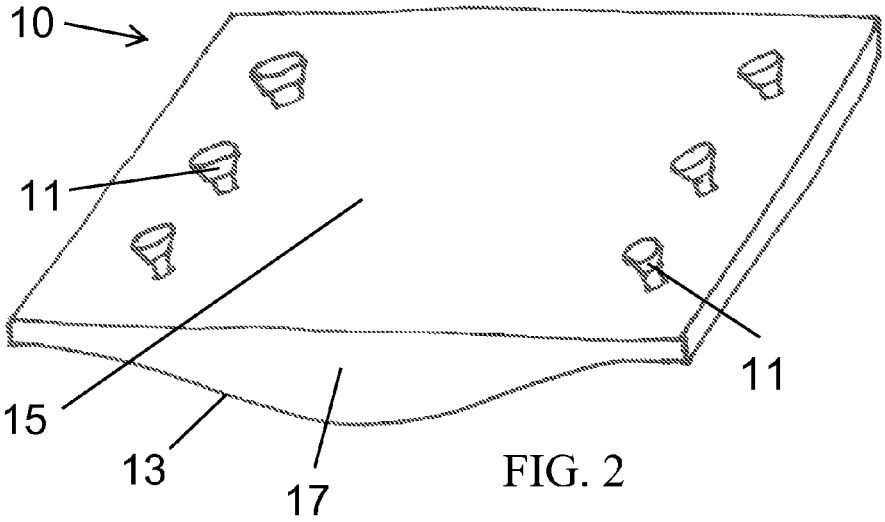
FIG. 2 is a perspective view of the bottom of the protective edge guard.

As shown in FIG. 2, the plurality of suction cups 11 is included along the bottom surface 15 of protective edge guard 10. The suction cups 11 are intended to temporarily affix the protective edge guard 10 in a stationary position onto the surface to which it is placed. The suction cups 11 can be of an assortment of shapes and sizes. The specific placement of the included suction cups 11 can be varied to optimize the strength of the adhesiveness of the protective edge guard 10 to the surface being protected. The specific placement of the suction cups 11 can be determined by those skilled in the art.

Figure 3:
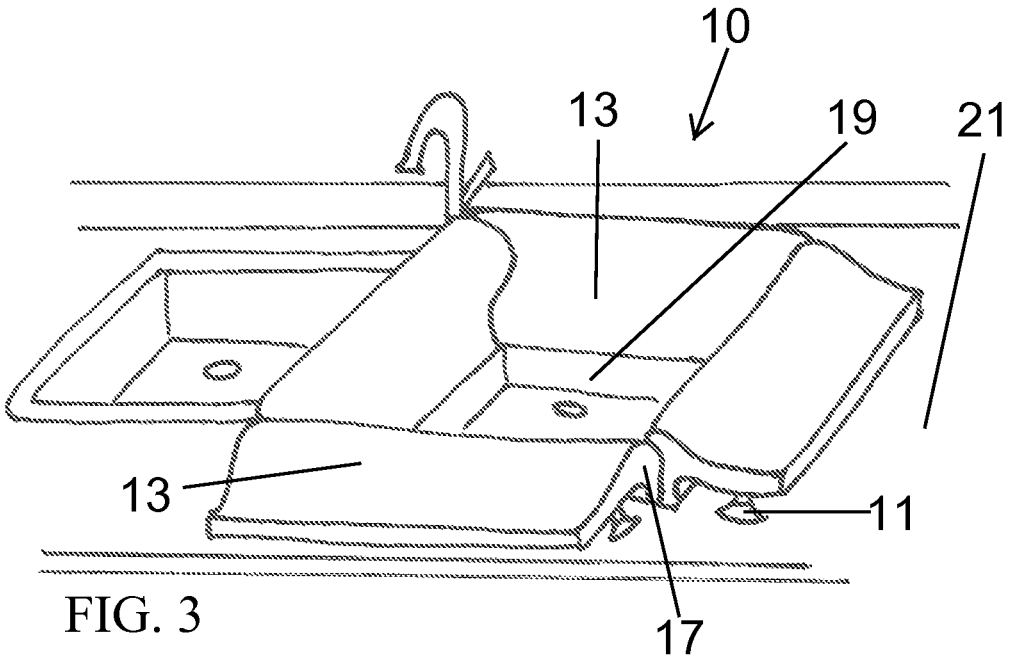
FIG. 3 is a perspective view of the protective edge guard shown as attached to a kitchen sink.
Figure 4:
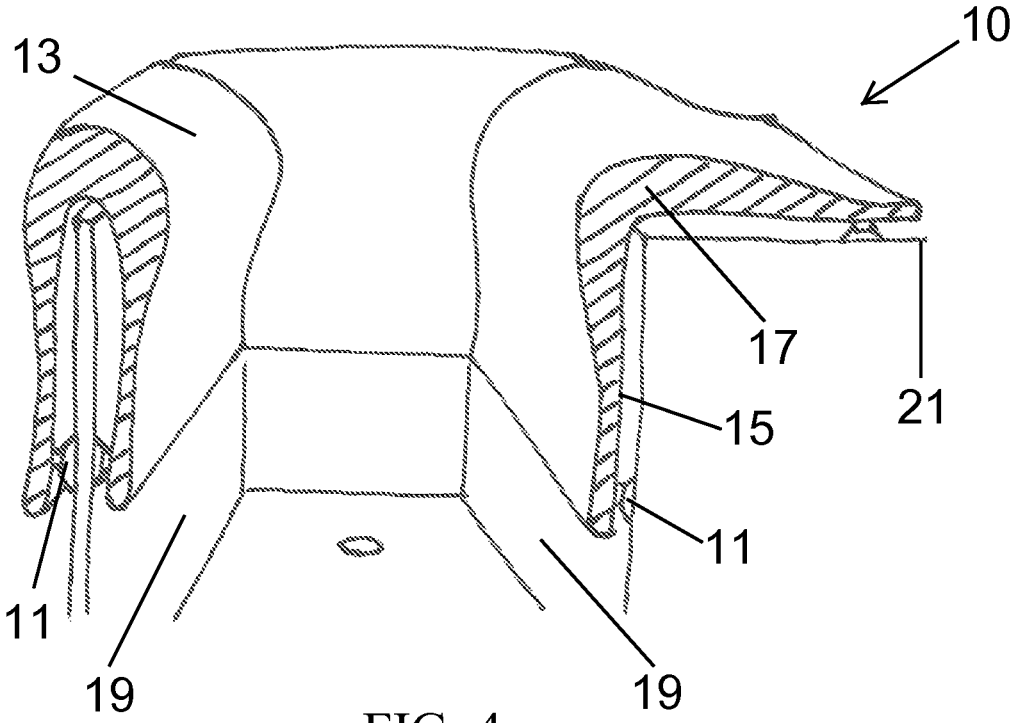
FIG. 4 is a cross sectional view of the protective edge guard shown as attached to a kitchen sink.

As shown in FIG. 3 through FIG. 6, the protective edge guard 10 can be affixed to most any smooth surface. As shown in FIG. 3 and FIG. 4, the protective edge guard 10 bends around the sides of a kitchen sink and attaches to the inside of the sink 19, and the counter top 21 via suction cups 11. As the safety guard 10 can be cut to fit a range of sink sizes, the entire sink, including the corners, and counter edges can be covered in order to offer optimum protective cushioning.

Figure 5:
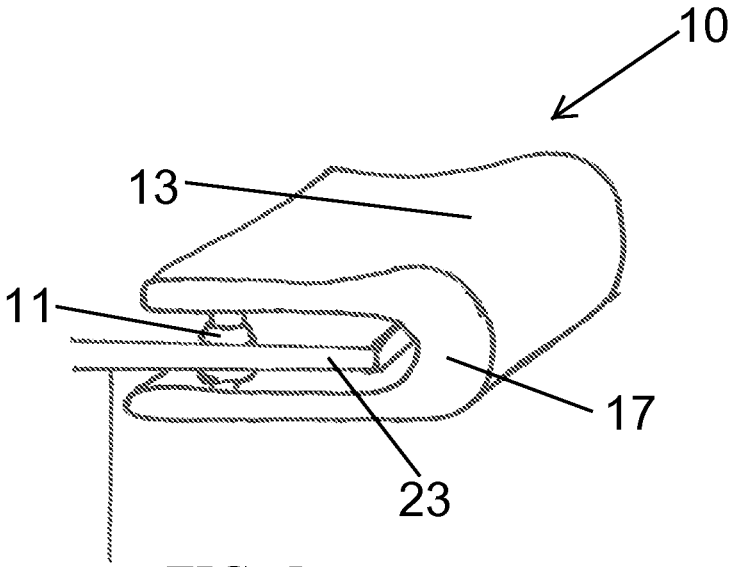
FIG. 5 is a perspective view of the protective edge guard shown as attached to an edge of a table.
Figure 6:
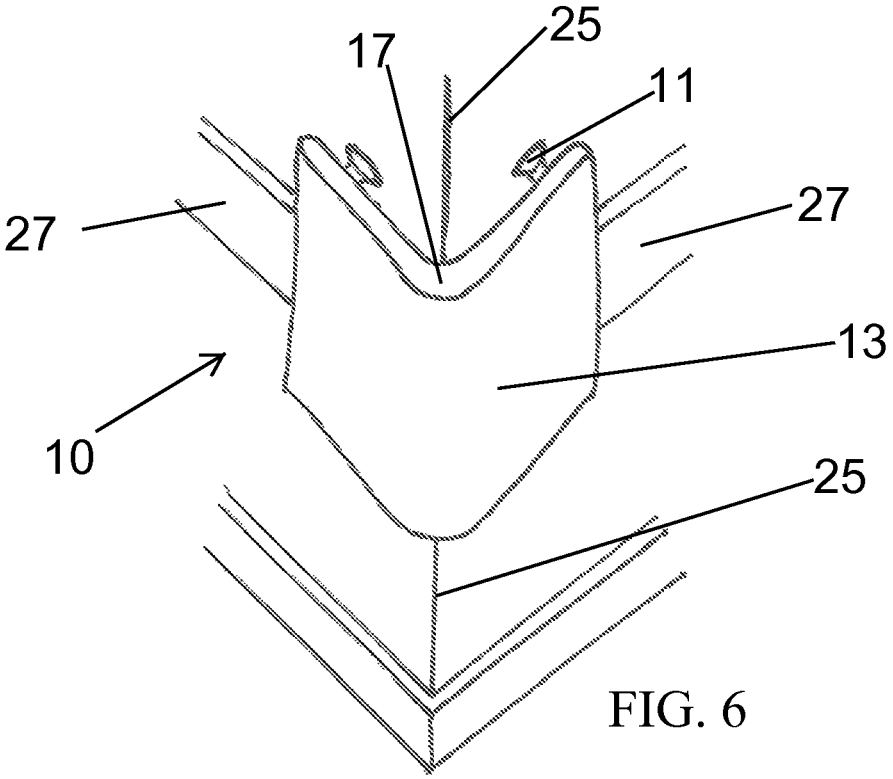
FIG. 6 is a perspective view of the protective edge guard shown as attached to a corner of a wall, covering trim work.

As shown in FIG. 5, the edge of a table 23 can be covered. As shown in FIG. 6, the corner of a wall 25 is covered by the protective edge guard 10. In particular, the protective edge guard 10 can be used to cover heavy projecting trim work 27 that poses a hazard if run into or bumped with force. The protective edge guard 10 can be utilized so long as the surface which the guard is being attached is smooth and will accept the adhesiveness of the suction cups 11.

Figure 7:
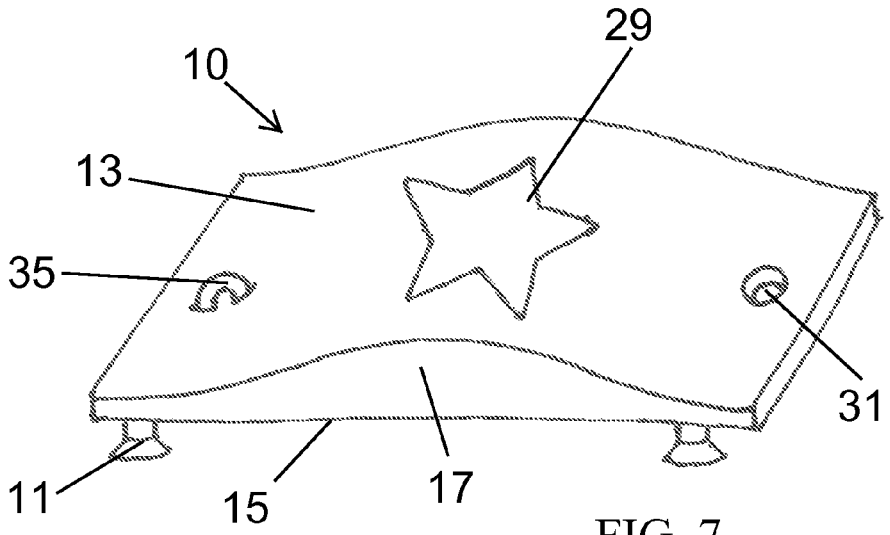
FIG. 7 is a top view of the protective edge guard shown with an optional design, an optional hole for toy attachment, and an optional loop for toy attachment.
Figure 8:
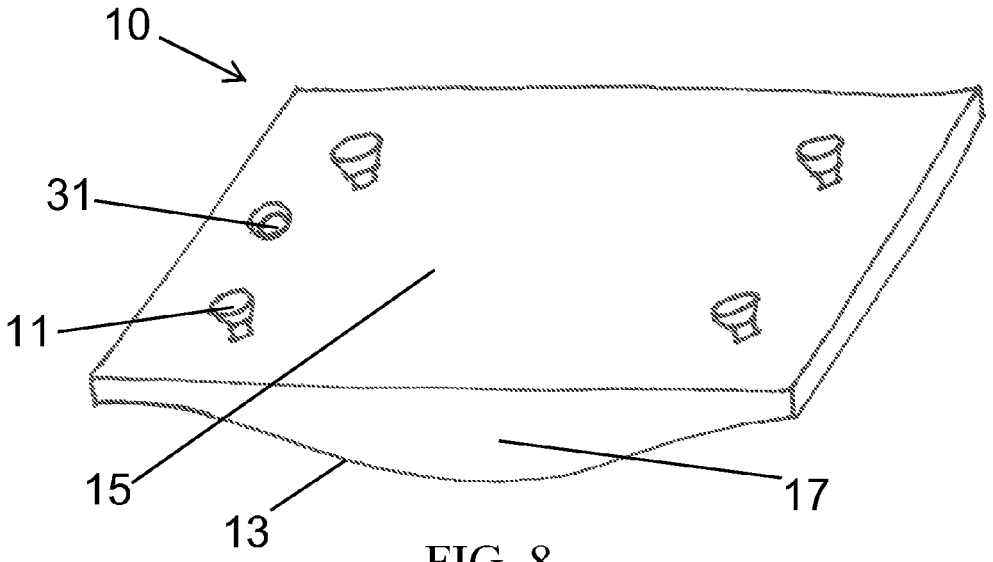
FIG. 8 is a bottom view of the of the protective edge guard shown with an optional hole for toy attachment.

As shown in FIG. 7, the design option 29 can be of a variety of shapes and designs, so long as they are pleasing to children. As shown in FIG. 7 and FIG. 8, an optional hole 31 and optional loop 35 can also be included, in order to attach a toy to the protective edge guard 10. An optional toy and design 29 are intended to entertain the child while being bathed in order to assist in keeping the child in a fixed position. The placement of the optional hole 31 and optional loop 35 can be determined by those skilled in the art.

Figure 9:
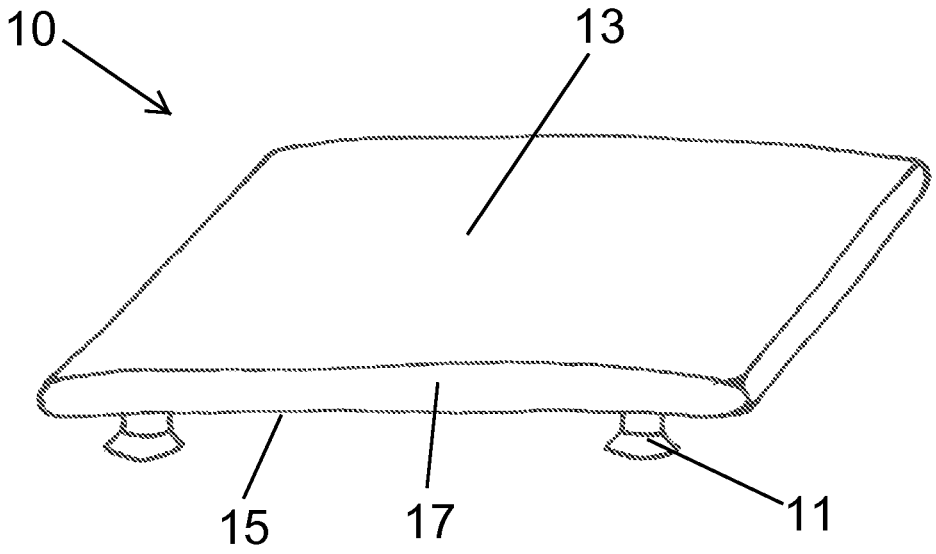
FIG. 9 is a perspective view of the protective edge guard shown as having a uniform thickness.

As shown in FIG. 9, the protective edge guard 10 can be of a uniform thickness. The center section 17 of the protective edge guard 10 can be of a range of thicknesses and widths so long as it offers adequate protection from hazardous impact with edges or corners. In an embodiment, the protective guard 10 can be a uniform thickness across the center section 17. The inner filling can be comprised of a compressible material so long as it can easily bend around the edge or corner being covered. Preferably, the inner filling is comprised of the same material as the protective edge guard 10 itself.

The protective edge guard 10, ideally made of a singular piece of material, can be made from any variety of materials so long as it is of a flexible nature and can easily bend around an edge or corner and cannot be torn easily. Such materials may include silicone, rubber, plastic-like material, or a tear resistant foam. Preferably the material can be cleaned in the dishwasher, is non-toxic to humans, safe for children, and easily cleaned. The protective edge guard 10 can be of a range of thicknesses and sizes in order to cover the edges of many varying sizes of household sinks, tables, counter edges, or corners of walls and trim work. Preferably the protective edge guard 10 will have a width of approximately between six and twelve inches and a length of between approximately nine and eighteen inches, but dependent on the use, other sizes may be used. The thickness and size can vary and can be determined by those skilled in the art. In a preferred embodiment, the protective edge guard 10 can be easily cut and customized to fit a range of lengths, in order to fit a variety of kitchen sink sizes, edges, and corners.

Hence, there has been shown and described a protective guard which satisfies the improvements sought. The disclosed embodiments are meant to be illustrative, not restrictive. It is apparent to those skilled in the art, however, that many variations, modifications, and other uses and applications to the guard are possible, especially with regard to shape, size, and materials. Such variations, modifications, and other uses and applications which do not depart from the essence and scope of the invention are considered to be encompassed by the present invention, which is limited only by the following claims.

What is claimed is:

1. A protective edge guard for use along the edge of a sink consisting of:

A homogenous, completely flexible pad, pliable enough to cover the edge of a sink, including the corners of the sink; wherein the predetermined length is greater than the predetermined width; the said pad having a generally rectangular planar bottom surface; said pad having a convexly rounded top surface; wherein the central portion of the rounded top surface of the pad protrudes upwardly away from the planar bottom surface and tapers to each long side of the generally rectangular pad; wherein the central portion of the pad, along the entire length of the pad, is relatively thicker than the tapered edges of each long side of the pad; wherein there are two parallel rows of a plurality of suction cups affixed to the planar bottom surface of the pad; wherein the suction cups extend from the planar bottom surface of the pad; wherein each row of suction cups is located generally close to each edge of each of the long sides of the rectangular planar bottom surface; wherein there is an absence of suction cups in the central portion of the planar bottom surface of the pad in the area directly opposite the convex protrusion of the top surface of the pad; wherein the said pad can be cut and customized to fit a range of different lengths.

2. The protective edge guard of claim 1, wherein the pad is made of a material selected from the group consisting of rubber, silicone, or plastic.

* * * * *